United States Patent [19]

Suzuki et al.

[11] Patent Number: 4,494,203

[45] Date of Patent: Jan. 15, 1985

[54] METHOD FOR CORRECTING THE DEVIATION OF A PREDETERMINED STOP POSITION IN A LOOM

[75] Inventors: Hajime Suzuki, Anjo; Shinichiro Matsuyama; Akio Arakawa, both of Kariya, all of Japan

[73] Assignee: Kabushiki Kaisha Toyoda Jidoshokki Seisakusho, Aichi, Japan

[21] Appl. No.: 367,959

[22] Filed: Apr. 13, 1982

[30] Foreign Application Priority Data

Apr. 18, 1981 [JP] Japan ..... 56-57822

[51] Int. Cl.[3] ..... D03D 51/44; G05B 19/26

[52] U.S. Cl. ..... 364/470; 364/170; 192/12 D; 192/142 R; 139/336

[58] Field of Search ..... 364/167, 168, 169, 170, 364/174, 470; 318/561, 568; 377/17; 192/12 D, 139, 142 R, 144; 139/336, 340

[56] References Cited

U.S. PATENT DOCUMENTS

| | | | |
|---|---|---|---|
| Re. 30,564 | 3/1981 | Brown et al. | 318/561 |
| 3,238,361 | 3/1966 | Frisch | 377/17 |
| 3,812,351 | 5/1974 | Coberley | 377/17 X |
| 3,917,930 | 11/1975 | Davey et al. | 318/561 |
| 4,021,647 | 5/1977 | Meier | 377/20 |
| 4,129,862 | 12/1978 | Kaplan et al. | 377/17 X |
| 4,161,649 | 7/1979 | Klos et al. | 192/144 X |
| 4,298,107 | 12/1981 | Schmitz et al. | 192/12 D |
| 4,321,580 | 3/1982 | Deleris | 377/17 X |
| 4,362,977 | 12/1982 | Evans et al. | 318/568 |
| 4,368,412 | 1/1983 | Inoue | 318/568 |

FOREIGN PATENT DOCUMENTS

| | | |
|---|---|---|
| 2952628 | 12/1978 | Fed. Rep. of Germany . |
| 2854257 | 6/1980 | Fed. Rep. of Germany . |

*Primary Examiner*—Jerry Smith
*Assistant Examiner*—Allen MacDonald
*Attorney, Agent, or Firm*—Burgess, Ryan & Wayne

[57] ABSTRACT

A method positioning control is disclosed, to stop mechanisms of a loom at predetermined positions when stopping the loom operation, in which the loom is directly controlled by a microcomputer. In the method, correction is made with respect to a predetermined position for commencing a braking operation so as to stop the mechanisms at said positions correctly. The above-mentioned correction is conducted by, first, obtaining the positional deviation between the actual stop position and the predetermined stop position during the last braking operation, second, using the obtained positional deviation for effecting identical correction regarding the next braking operation, etc. repeated over and over.

3 Claims, 6 Drawing Figures

METHOD FOR CORRECTING THE DEVIATION OF A PREDETERMINED STOP POSITION IN A LOOM

The present invention relates to a method for positioning control to stop mechanisms of a loom at predetermined positions when stopping the loom operation, in which the loom is directly controlled by a microcomputer.

Microcomputers have come into increasingly wider use in recent years. Now, they are even used for control of looms. Use of microcomputers for direct control of looms has the following advantages:

1. Prevention of inferior production due to misoperation or motion stopping trouble.

2. Improvement of ability to detect abnormalities or trouble in the loom control system and facilitation of maintenance.

3. Diversification of specifications and greater freedom of specification modifications through microcomputer programs.

Use of microcomputers also enables easy realization of special types of control almost impossible in conventional non-microcomputer-controlled looms. The present invention relates to one such special type of control, i.e., stop positioning. "Stop positioning" means stopping the mechanisms of the loom at predetermined positions when stopping the motor in the loom due to, for example, warp or weft yarn breakage or other abnormalities. "Position", in this case, specifically denotes the crank angle of the crankshaft (primary shaft) working in synchronism with said motor. The crank angle of the crankshaft specifies the operational timing position of all the mechanisms in the loom.

Problems arise, however, in that it is very difficult to guarantee the crankshaft always stops at the predetermined crank angle when stopping the motor. This is because it is impossible to maintain a constant braking force over a long period due to gradual abrasion of the brake cooperating with said motor. If the above-mentioned stop positioning is not correctly performed, the mechanisms of the loom will stop at operational timing positions undesirable for, for example, repairing broken warp or weft yarn. With looms provided with air-jet type weft feeding apparatuses, there is the further danger that the loom will stop at an operational timing position where the apparatus continue to blow air.

In the prior art, when erroneous stop positioning occurred, the operator had to manually adjust the timing positions of the mechanisms in the loom. Microcomputers can be used to eliminate this manual operation through a special stop positioning operation; however, such a stop positioning operation may also be realized using equivalent hardware instead of a microcomputer.

It is an object of the present invention to provide a method for stop positioning automatically ensuring the predetermined constant stop position, every time the motor is stopped, without relying on the conventional manual operation.

The present invention will be more apparent from the ensuing description with reference to the accompanying drawings, wherein.

Figure 1:
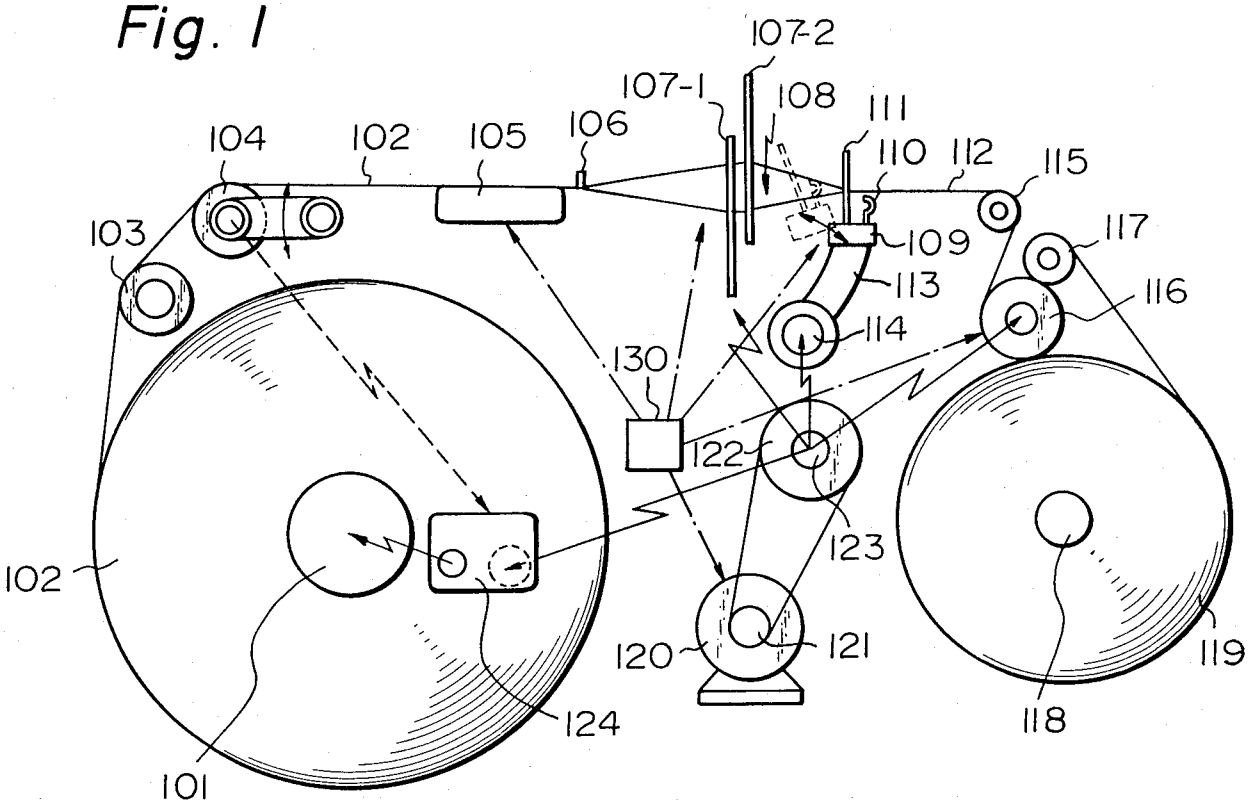
FIG. 1 is a schematic whole view of a typical construction of the loom to which the present invention is applied.

FIG. 1 is a schematic whole view of a typical construction of the loom to which the present invention is applied. In FIG. 1, the reference numeral 101 indicates a yarn beam. The yarn beam has wrapped around it in parallel a great number of warp yarns 102. The warp yarns 102 are led via a back roller 103 and a tension roller 104 to a warp stop motion unit 105. The warp stop motion unit 105 contains droppers (not shown) for each warp yarn. If any warp yarn breaks or comes to its end, the corresponding dropper detects this and starts an operation to stop the running of the frame. The warp yarns 102 pass through the warp stop motion unit 105 and, while pressed by means of a presser bar 106, are alternately divided up and down into two groups by heald frames 107-1 and 107-2, thereby forming an opening 108 between the divided warp yarns. A weft yarn is inserted at very high speed into the opening 108 by means of a weft yarn feeder (not shown), for example, an air-jet nozzle. The insertion is guided by a sley 109 mounting a picking guide 110. The sley 109 is also provided with reeds 111. The reeds 111, through the swing motion of the sley 109, beat the weft yarn rightward in FIG. 1 with each insertion of weft yarn into the opening 108 to produce woven fabrics 112. The above-mentioned swing motion of the sley 109 is provided via a sley sword 113 by a rocking shaft 114.

The woven fabrics 112 pass via a brest beam 115, surface roller 116, and a press roller 117 and are wound around a winding roller 118. Reference numeral 119 indicates the wound woven fabrics.

The power for the above-mentioned operations is provided by a motor 120. The rotational driving power of the motor 120 is transmitted via a motor pulley 121 to a driving pulley 122 to turn a crankshaft 123. The rotational driving power is fed to predetermined units along jagged arrows (FIG. 1). The yarn beam 101 receives the rotational driving power by way of a transmission 124. The transmission 124 is supplied with a feedback signal from the tension roller 104 along the dotted jagged arrow. The feedback signal is effective for maintaining suitable tension on the warp yarns 102.

The present invention is preferably applied to a loom directly controlled and managed in operations by a microcomputer. The microcomputer is schematically represented by a block having the reference numeral 130. The microcomputer 130 communicates with the other mechanisms as schematically indicated by the chain dotted arrows. (In practice, communication is effected by signal lines connected to the microcomputer 130 at its various I/O ports (input/output ports).)

Figure 2:
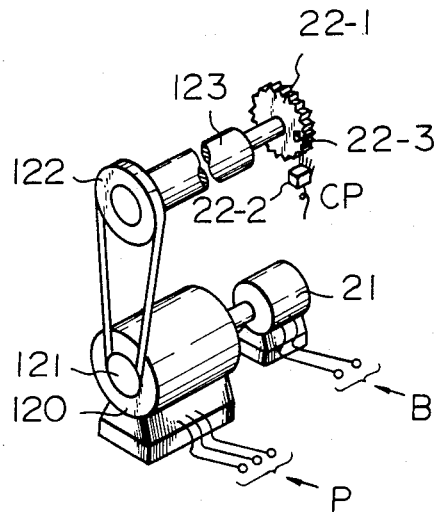
FIG. 2 is a perspective partial view of the construction shown in FIG. 1, especially that part concerning the present invention.

FIG. 2 is a perspective partial view of the construction shown in FIG. 1, especially that part concerning the present invention. In FIG. 2, the members 120 through 123 correspond to those in FIG. 1. A braking device 21 is directly connected to the primary shaft of the motor 120 (it should be understood that an identical braking device may be connected to predetermined portions of other mechanisms of the loom such as the crankshaft). When stopping the motor 120, a power source P is cut and, at the same time, a braking power source B is supplied to the braking device 21. This brings the crankshaft 123, which had been rotating via the pulleys 121 and 122, to a sudden stop. Usually, the crankshaft 123 stops rotating within one rotation. The crankshaft 123 must stop at the predetermined constant position (crank angle). To ensure this, the crankshaft is usually provided with a crank angle detecting apparatus (22) to continually supervise the crank angle. The apparatus (22) is comprised of, for example, a disc 22-1 provided with peripheral teeth at constant intervals and a sensor 22-2 fixed close to the disc 22-1. The sensor 22-2 produces a crank angle pulse CP, each time a tooth of time the disc 22-1 approaches it, through, for example, a magnetic coupling effect. Thus, successive crank angle pulses are produced therefrom in a pulse train. In this arrangement, the absolute value of the crank pulse angles is defined by a permanent magnet 22-3 attached to a predetermined portion on the disc 22-1. This portion functions as a so-called home position.

Instead of using a crank angle detecting apparatus counting the number of generated pulses, as illustrated in FIG. 2, one can also use a crank angle detecting device using an absolute encoder directly indicating the crank angle on the disc by forming a binary code or other coded pattern.

When a request signal is issued to stop the operation of the loom, the braking is applied starting at a predetermined crank angle so as to stop the crankshaft 123 completely at the predetermined constant position.

Figure 3:
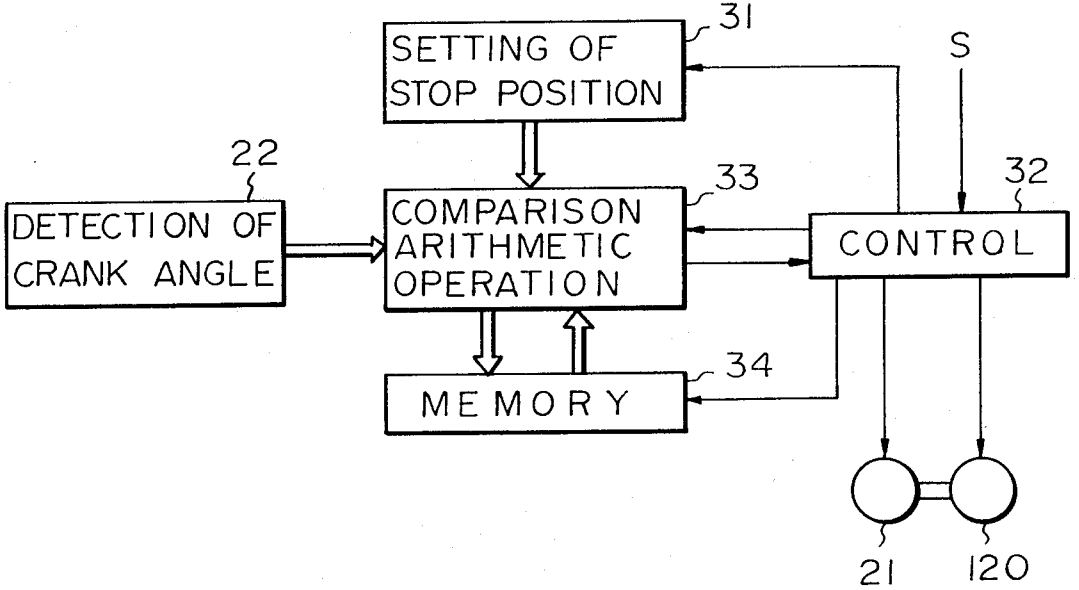
FIG. 3 is a block diagram of one example of a circuit for carrying out the method of the present invention.

FIG. 3 is a block diagram of one example of a circuit for carrying out the method of the present invention. In FIG. 3, the motor 120, the braking device 21, and the crank angle detecting apparatus 22 correspond to those explained in FIG. 2. The motor 120 and braking device 21 are controlled by a control circuit 32. When the request signal S for stopping the operation of the loom is generated, the crankshaft starts being braked to stop at the predetermined constant position specified by a stop position setting device 31. The remaining members, comparison-arithmetic operation circuit 33 and memory circuit 34, especially relate to the present invention. These circuits are illustrated as discrete modules, but are actually contained in the aforementioned microcomputer 130 and controlled by a program therein.

Figure 4:
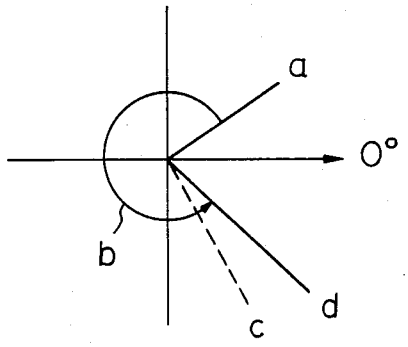
FIG. 4 is a graph for schematically explaining the conception of the crank angle.
Figure 5A:
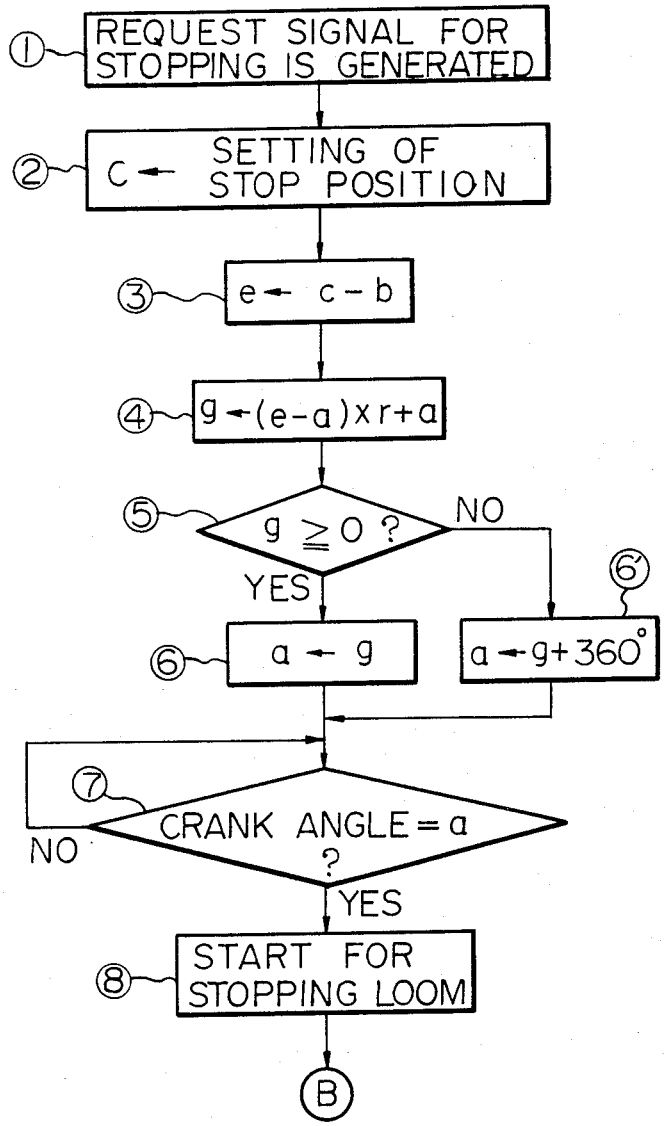
FIGS. 5A and 5B are flow charts for explaining the method of the present invention step by step along the process thereof.
Figure 5B:
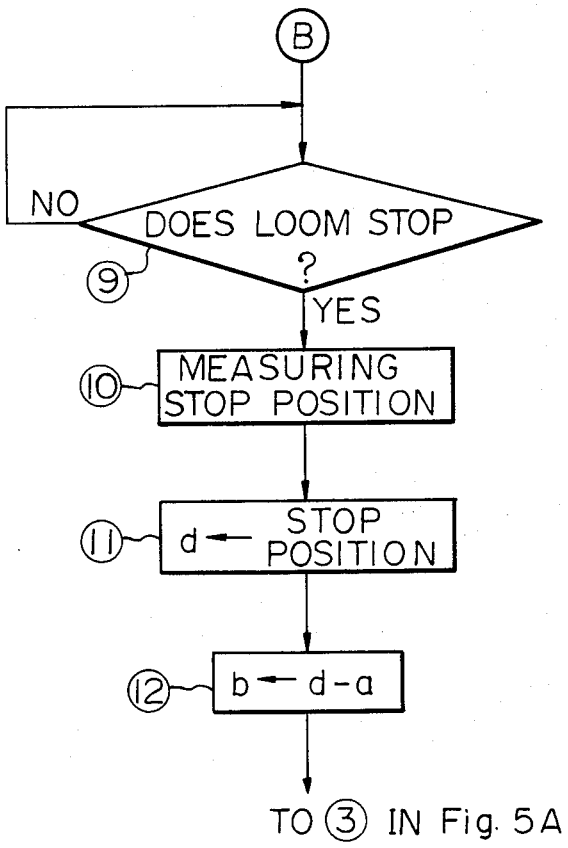

The method of the present invention will now be explained in detail below. FIG. 4 is a graph for schematically explaining the concept of the crank angle. FIGS. 5A and 5B are flow charts for explaining the method of the present invention step by step along the process thereof.

In FIG. 4, the symbol a denotes the crank angle at which the braking operation commences. The symbol c denotes the crank angle of the predetermined constant stop position (angle). The crank angle c is preset, as digital data, in the stop position setting device 31 (FIG. 3). In FIG. 4, the crank angle c is illustrated as about 300°. However, as previously mentioned, since the braking force tends to fluctuate over long periods, the crankshaft may stop away from the correct crank angle c, such as at a crank angle d. The reference symbol b denotes an angular range within which the braking operation is completed.

In FIG. 5A, first, a request signal S (FIG. 3) for stopping the loom is generated (step ①). The digital preset value (c in FIG. 4) is transferred to the comparison. arithmetic operation circuit (33 in FIG. 3) (step ②). The time to transfer the preset value c is determined by the control circuit (32 in FIG. 3). It should be noted that in FIG. 3, the arrows indicated by double lines represent directions of flow of data, while the arrows indicated by single lines represent directions of flow of control signals. The comparison-arithmetic operation circuit 33 (FIG. 3) executes an arithmetic operation $e \leftarrow c-b$ (step ③). It is important to note that the value b is data obtained during the last braking operation. That is the positional deviation from the correct stop position measured during one braking operation is stored as data in the memory circuit (34 in FIG. 3), and is utilized as data for effecting adjustment during the next braking operation. Similarly, the positional deviation measured during said next braking operation is utilized as data for effecting adjustment during the subsequent braking operation.

The stored data b must be preserved even throughout power blackouts or temporary idling of the loom so that it can be used in the coming operation when the loom is restarted. Therefore, the memory circuit 34 must be made of a nonvolatile memory.

Step ③ of FIG. 5A calculates data e. Data e is the mid-calculation value and is a basic value which is used for achieving correction of the crank angle at which the braking operation is started. Step ④ executes an arithmetic operation regarding $g \leftarrow (e-a) \times \gamma + a$. The symbol $\gamma$ denotes the so-called correction factor and is selected to be, for example, $\frac{1}{2}$. If the correction factor is selected to be 1, 100% correction is made every time. However, if such 100% correction is effected, the resultant signal of the feedback loop control would deviate due to existences of disturbances and/or errors. This might cause the actual crank angle d to deviate from the correct crank angle c. Accordingly, the correction factor $\gamma$ is usually set lower than 1.

The data g obtained through step ④ has a positive or negative value. Discrimination whether data g is positive or negative is performed in step ⑤. If data g is positive (YES), data g is used as is for data a (step ⑥). If data g is negative (NO), data g is added to 360° for data a (step ⑥). The above-mentioned operations are performed mainly by using the comparison.arithmetic operation circuit 33.

The aforesaid crank angle detecting apparatus (22 in FIG. 3) detects whether or not the crank angle a (crank angle for starting the braking operation) coincides with the crank angle specified by the aforesaid data g or g+360° (step ⑦). Step ⑦ is repeatedly executed until coincidence is detected (YES). When coincidence is detected, the stop operation for the loom is started (step ⑧). That is, the control circuit 32 of FIG. 3 deenergizes the motor 120 and simultaneously energizes the braking device 21.

Thus, the correct stop positioning operation is achieved. In the stop positioning operation, the actual angular range b to be detected during the present braking operation must be measured, because the measured new angular range b will be necessary for the subsequent braking operation. Referring to the flow chart of FIG. 5B, linked at Ⓑ with that of FIG. 5A, first it is detected whether or not the loom is completely stopped (step ⑨). When the loom stops, the actual stop position is measured (step ⑩). This measurement is conducted by the crank angle detecting apparatus 22. Thus, data regarding the actual stop position, that is the crank angle d, is obtained (step ⑪). According to data d, an arithmetic operation $b \leftarrow d-a$ is executed (step ⑫)

and, thereby, data b which will be used for adjustment in the subsequent braking operation is prepared and stored in the memory circuit. It should be noted that data b appearing in step ③ of FIG. 5A has already been prepared during the preceding braking operation through a step identical to step ⑫ of FIG. 5B. If desirable, one can arrange for an alarm or recommendation message to be generated to indicate that the braking force is too small (or large) when step ⑫ gives an angular range b outside a predetermined nominal value.

As mentioned above, the present invention enables the automatic adjustment of a certain range of stop position deviation that is, without requiring any manual adjustment, and thereby enables the realization of an almost maintenance free loom.

We claim:

1. A method for braking a rotatable shaft coupled to the driving mechanism of a loom, so that the shaft stops at a predetermined crank angular stop position during successive braking operations occurring at randomly spaced time intervals by means of a braking device cooperating with and being connected with a motor for driving said loom, said method comprising the steps of:

(a) determining the positional deviation between the actual stop position obtained during the last conducted braking operation and said predetermined stop position and storing the value of said positional deviation in a read/store enable memory, said positional deviation being determined according to the relation $$e \leftarrow c - b$$

where the symbol c denotes a crank angle, as digital data, corresponding to the predetermined stop position, the symbol b denotes a crank angle, as digital data, corresponding to an angular range through which the braking operation is completed, and the symbol e denotes resultant digital data derived from the operation of "c−b", indicating the positional deviation;

(b) reading the positional deviation from said read/-store enable memory and determining a resultant crank angle numerical value according to the relationship $$g \leftarrow (e-a)\gamma + a$$

where the symbol a denotes a crank angle, as digital data, at which the braking operation commences, the symbol $\gamma$ has a value less than 1 and denotes a predetermined correction factor, and the symbol g denotes a resultant crank angle digital value;

(c) determining whether the resultant crank angle value g is positive or negative;

(d) determining the crank angle value a′ at which the next succeeding braking operation is to be initiated, (i) according to the relationship $a' \leftarrow g$ when g is positive and (ii) according to the relationship $a' \leftarrow g + 360°$ when g is negative, thereby effecting correction of the position for commencing the braking operation;

(e) initiating said next succeeding braking operation by means of said braking device immediately when the crank angle coincides with the crank angle value a′; and (f) repeating steps (a) through (e) automatically every time the next following braking operation is performed.

2. The method according to claim 1, wherein the crank angle corresponding to the range through which the braking operation is completed, is stored in a non-volatile read/store enable memory.

3. The method according to claim 1, comprising the additional step of generating an alarm when the crank angle corresponding to the range through which the braking operation is completed, exceeds a predetermined limit.

* * * * *